United States Patent [19]

Zherdev et al.

[11] 4,071,230

[45] Jan. 31, 1978

[54] CONTRIVANCE FOR THE PROTECTION OF THE WALLS OF A SHAFT FURNACE FROM THE HEAT EFFECT OF METALLURGICAL PROCESS

[76] Inventors: Anatoly Vasilievich Zherdev, ulitsa Zhdanova, 9; Grigory Savvich Yakimenko, ulitsa Lenina, 9, kv. 16, both of Kommunarsk Voroshilovgradskoi oblasti; Lev Dmitrievich Gritsuk, ulitsa Kombainovskaya, 13, kv. 3, Kharkov; Anatoly Stepanovicy Gorbik, prospekt Lenina, 24, kv. 31, Kharkov; Evgeny Grigorievich Belkin, ulitsa Svetlaya, 19, kv. 156, Kharkov; Jury Ivanovich Tseluiko, prospekt Lenina, 17, kv. 55, Kharkov; Yakov Izrailievich Gorodetsky, prospekt Gagarina, 25, kv. 32, Kharkov; Vasily Fedorovich Severin, ulitsa Chapaeva, 168v, kv. 4, Kommunarsk Voroshilovgradskoi oblasti; Alexei Ivanovich Tolochko, Pushkinsky viezd, 5, kv. 7, Kharkov, all of U.S.S.R.

[21] Appl. No.: 780,267

[22] Filed: Mar. 23, 1977

[51] Int. Cl.[2] ..... C21B 7/10

[52] U.S. Cl. ..... 266/193

[58] Field of Search ..... 266/190, 193, 194

[56] References Cited

U.S. PATENT DOCUMENTS 3,881,860 5/1975 Brandenburg ..... 266/193

*Primary Examiner*—Gerald A. Dost

[57] ABSTRACT

A contrivance for the protection of the walls of a shaft furnace from heat effect comprising a metal plate serving to shield the surface of walls facing the interior of the furnace and at least two essentially U-shaped tubes for a coolant linked up with the plate and attached to the furnace wall with their open ends. The plate is more longer in the vertical direction than wide in the horizontal one and is made up of separate blocks, each block being more wider in the horizontal direction than long in the vertical one and is provided with grooves accommodating the tubes in that surface which faces the furnace wall. The grooves are lined with a layer of heat conductor, and provided in the intervals between the grooves are means of fastening each block to the tubes which, in their turn, are provided with fasteners welded thereto and serving the purpose of attaching to the wall.

2 Claims, 3 Drawing Figures

CONTRIVANCE FOR THE PROTECTION OF THE WALLS OF A SHAFT FURNACE FROM THE HEAT EFFECT OF METALLURGICAL PROCESS

The present invention relates to shaft furnaces and has specific reference to contrivances for the protection of the walls of a furnace from heat effect. It may find utility in safeguarding the casing of a blast-furnace stack against an overheating which is likely to impair the mechanical strength thereof.

Process intensification aimed at enhancing the capcity of shaft furnaces by increasing the temperature or pressure of air blast, enriching the air blast with oxygen, etc. is widely used nowadays. Yet, any attempt to intensify the process results in a rise of both the operating temperature and the associated heat stress on the furnace walls, bringing about an early damage thereof. To prevent this, the requirements to be met by the contrivances serving to shield the internal surface of the furnace casing and protect same from overheating are constantly increasing in point of both durability and dependability. A fact not to be overlooked in this context is that the intensity of the heat effect exposed whereto is a contrivance protecting the furnace wall varies with time, for the slag hardened on the furnace wall can either build up by a further amount or disintegrate with the result that the heat stress upon the contrivance either decreases or increases. In other words, the contrivance is subject to variable stresses.

Widely known in the art is a contrivance for the protection of the walls of a shaft furnace from heat effect consisting of a ribbed cast iron plate attached to the furnace wall and shielding same from the furnace interior. Fixed in the plate are at least two tubes providing passages circulating wherethrough is a coolant. The open inlet of each tube are passed through the furnace wall along the shortest path. The ribbed surface of the plate improves the adhesion of the slag hardened thereon and serves to lessen in this way the heat stress coming on the contrivance. The tubes which are in steel are cast into the cast iron plate. The tube carburization of a high order occuring in the course of casting the tubes deprives same of plasticity so that their behaviour is turned into a brittle one.

The durability of the contrivance for protecting the walls of a shaft furnace against heat effect largely depends on the coolant circulated through the tubes of the plate for cooling same. Industrial water used as the coolant scales the inner walls of the tubes to a point when these become blocked with scale and water ceases to circulate. This results in overheating and destruction of a plate or a bank of plates served by the same cooling circuit and may lead to a burning-out of the furnace wall eventually. The remedy is to use chemically-treated water as the coolant but this practice has failed to attain wide recognition due to high cost of such water.

The problem of cooling the plates has found its radical solution with the introduction of a mixture of steam and water as the coolant circulating over a closed-loop circuit provided with a means of bleeding steam thereof and a means of topping up the chemically-treated water therein. Heat is removed from the plates due to the boiling of water in tubes, and some water transformed into steam is lost from the circuit. Yet, the heat of the vapourization of water being great, these losses are small, and the cost of treating chemically the water used as the refill is low as well.

The probing into causes of failures indicates that protective contrivances suffer mainly from the cracking of plates triggered by thermal stresses exposed whereto are the plates in the course of furnace run. Expanding due to warming up, the absolute thermal expansion being at its maximum in the direction coinciding with the longest dimension of the plate which is the vertical one, the cast iron plate exerts a vertically-applied force on the tubes cast thereinto and, since the tubes are rigidly attached to the furnace walls at their ends, similar stresses are set up in the tubes. The cooling of the plate has the same effect, reversing, however, the direction of the stresses. These repeated alternate stresses result in the straining and failure of both plates and tubes.

Damaged tubes are sources of leaks into the furnace space of the coolant circulating through the tubes, and these leaks cause an increase in the heat requirements per unit of product, for some of the heat in the furnace is wasted in evaporating the coolant leaking thereinto. Heavy leaks associated with the escapement of coolant into the furnace in considerable amounts from the faulty contrivance for the protection of shaft walls may even interfere with the process taking place in the furnace.

Yet, any tube damage results in a rise of the consumtion of the coolant serving to cool the plates because the closed-loop cooling circuit is turned into an open-loop one which calls for increasing the amount of costly chemically-treated water used in topping up. Since reliable and quick techniques of locating damaged places are lacking at present, much time may pass before a leak is detected and the defective tube disconnected from the circuit, entailing the ingress of coolant into the furnace in considerable amounts. The problem is not solved just by disconnecting the damaged tube because the job of replacing same includes awkward and wasteful cooling of that portion of the furnace wall which is protected by the plate with the defective tube. Existing at the same time there is the danger of a wall failure with all its consequences if a damaged contrivance is not located in good time or suffering from damage are more than one contrivance located side by side.

It is an object of the present invention to enhance the operational dependability of a contrivance for the protection of the walls of a furnace from heat effect by increasing the resistance of the plates to thermal fatigue.

Another object of the present invention is to protract the period between overhauls of a furnace by extending the trouble-free service life of the contrivances for the protection of the walls of a surface from thermal effect.

The last but not the least object of the present invention is to minimize the possibility of a furnace wall failure.

In accordance with said and other objects the essence of the present invention is that in a contrivance for the protection of the walls of a shaft furnace from the heat effect of metallurgical process comprising a metal plate which shields the surface of walls facing the interior of the furnace and is two or three times longer in the vertical direction than wide in the horizontal one as well as at least two essentially U-shaped tubes for a coolant which are linked up with the plate and attached to the furnace wall at their open ends, the metal plate is according to the invention made up in blocks each whereof is more wider in the horizontal direction than long in the vertical one and the surface whereof facing the furnace wall is provided with grooves lined with a layer of heat conductor and accommodating the tubes, whereas provided in the intervals between the grooves are means of fastening each block to the tubes and these means are provided with fasteners welded thereto and serving the purpose of attaching to the furnace wall.

By providing a contrivance on the above lines its operational dependability is enhanced because the resistance of the plates to thermal fatigue is also increased inasmuch as the blocks comprising the plate of the contrivance are free to move due to thermal expansion along the tubes attached whereto they are. The fact that each individual block is held down to the tubes and these, in their turn, are attached to the furnace wall is a factor contributing to the resistance of the tubes to thermal fatigue, for any mechanical effect of the plate on the tubes is excluded. Enhanced resistance of the plate and tubes protracts the service life of the contrivance or, in other words, extends the period between overhauls of the furnace. Since all these innovations eliminate the main cause of tube damage, the possibility of a furnace wall failure is considerably reduced.

By providing in each groove of the plate a layer of heat conductor interposed between the tubes and each block, a good cooling of the blocks is achieved, preventing overheating and softening thereof.

By attaching the tubes to the furnace wall by intermediate fasteners welded to the tubes, the plate is released of the rigid links with the furnace wall so that the cracking of the plate due to the thermal expansion is prevented. The temperature of the tubes and, consequently, the amount of thermal expansion brought about thereby is always less than that of the metal plate, and the magnitude of the stresses set up by this temperature in the tubes is not as great as to cause damage thereto. The intermediate fasteners welded to the tubes provide for a clearance between the contrivance and furnace wall which guarantees adequate thermal insulation.

It is expedient that the contrivance is provided with additional fasteners each whereof is loosely fitted to at least two tubes and is connected to the block through the intermediary of the means of fastening same.

Other objects and advantages of the present invention will be best understood from the following detailed description of a preferred embodiment of the invention when this description is being read in conjunction with the accompanying drawings in which:

FIG. I is a schematic side elevation, partly in cross section, of the contrivance for the protection of the walls of a shaft furnace from heat effect in accordance with the invention;

Figure 1:
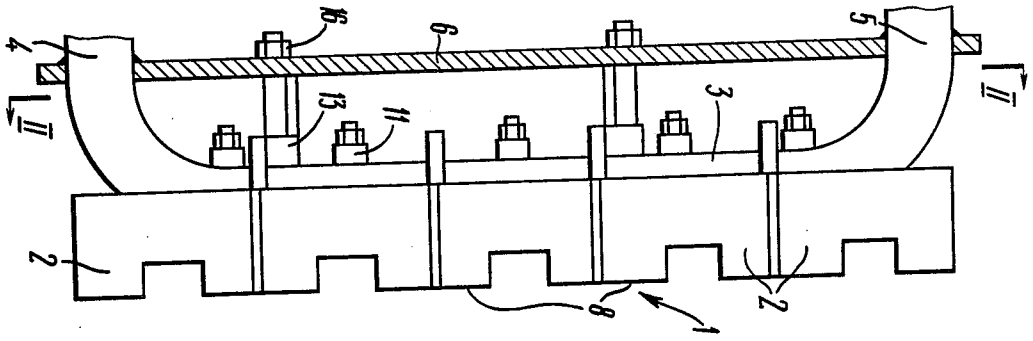
Figure 2:
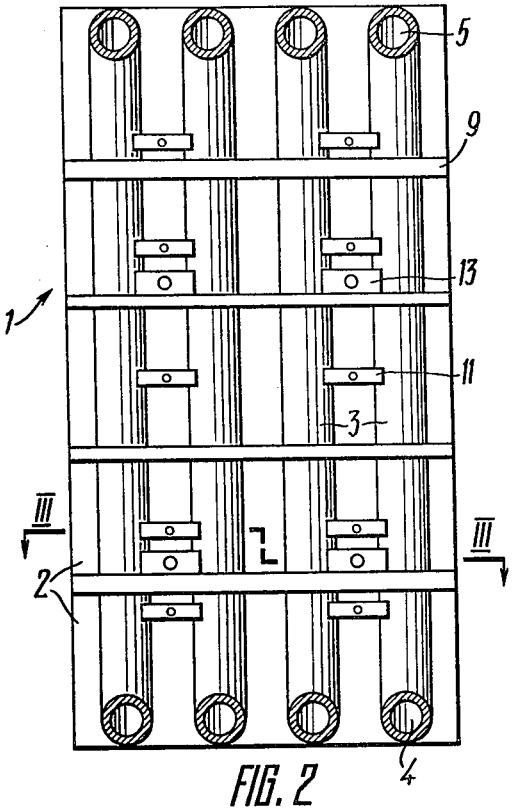
FIG. 2 is a section of line II—II of FIG. I.
Figure 3:
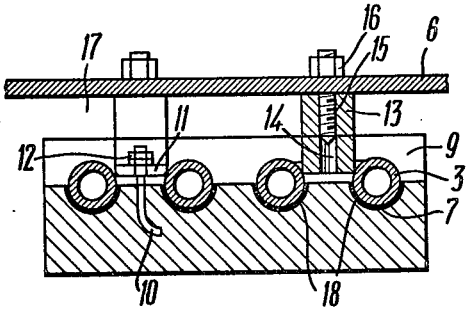
FIG. 3 is a section on line III—III of FIG. 2.

Referring to FIG. I, the contrivance for the protection of the walls of a shaft furnace from heat effect comprises a metal plate I made up in individual blocks 2 each whereof is more wider in the horizontal direction than long in the vertical one and at least two U-shaped tubes (FIG. 2) for a coolant to circulate therethrough. An inlet end 4 and an outlet end 5 of each tube 3 pass through the furnace wall 6 (FIG. I) and are connected to a cooling circuit (not shown). Each of the blocks 2 is provided with grooves 7 (FIG. 3) accommodating tubes 3 in that surface which faces the furnace wall 6 whereas the surface of block facing the interior of the furnace is provided with ribs 8 (FIG. I). The tubes 3 are rigidly interlinked by bars 9 (FIG. 2) holding them in the grooves 7 (FIG. 3) of the blocks 2. Each block 2 is attached to the tubes 3 by hold-down strips, e.g. lath springs II, and by studs 10 with nuts 12, the studs being anchored in the intervals between the grooves 7 for the tubes 3. Each block 2, integrally with the tubes/3/fitted whereto it is, is attached to the furnace wall 6 by bosses 13 welded to the tubes 3. Each boss is provided with a tapped hole 14 screwed whereinto is a stud 15, and the contrivance is attached to the furnace wall 6 by tightening nuts 16 of the studs 15. To facilitate the heat transfer from the blocks 2 to the tubes 3, a layer of heat conductor 18 is placed in the grooves 7.

The number of the blocks 2 comprising the metal plate I is decided by the height and width of the contrivance under the condition that each block 2 is two to three times wider than it is long. The number of the cooling tubes 3 in the contrivance is decided by the width of the plate and by the thermal load the contrivance is bound to sustain in each particular furnace. The diameter of the cooling tubes 3 is selected so as to provide for adequate rigidity of the contrivance and taking into account the thermal load coming thereon.

The heat maintained in the furnace warms up the metal blocks 2 of each contrivance and the blocks, in their turn, convey the heat flux to the walls of the tubes 3 through the layer of heat conductor 18. The tubes 3 are cooled by the coolant circulating therethrough, on being admitted from the cooling circuit through the open ends 4, and brought to the boil therein. The mixture of water and steam is discharged into the cooling circuit through the ends 5. So the contrivance protects the furnace walls from overheating and damage.

On heating up, the blocks 2 expand, being free to elongate parallel to the axis of the tubes 3 by virtue of the means of fastening 10, 11 and 12 used which do not obstruct this even in the least way. As a result, the displacment of the blocks 2 does not affect the tubes 3 mechanically. The tubes 3 are effectively cooled by the coolant circulating therethrough and, as a consequence, they operate at a temperature which is too low for the damaging stresses being set up therein. Thanks to that, the tubes 3 remain intact even being rigidly attached to the furnace wall 6 at their inlet and outlet ends 4 and 5, respectively, and held down to the furnace wall 6 by the studs 15 screwed into the bosses 13.

Thus, the contrivance for the protection of the walls of a shaft furnace against heat effect enhances the operational dependability of the cooling of shaft furnaces—this being attributed to high endurance of metal plates—, extends the period between overhauls of a furnace and minimizes the possibility of dangerous furnace wall failures.

What is claimed is:

1. A contrivance for the protection of the walls of a shaft furnace from the heat effect of metallurgical process comprising blocks each whereof is more wider in the horizontal direction than long in the vertical one and which constitute all together a metal plate serving to shield the surface of walls facing the interior of the furnace and given a size which is two or three times longer in the vertical direction than wide in the horizontal one, at last two essentially U-shaped tubes for a coolant attached to the furnace wall with its open ends, grooves for said tubes provided in that surface of each of said blocks which faces the furnace wall, a layer of heat conductor provided in said grooves for said tubes, means of fastening each of said blocks to said tubes provided in the intervals between said grooves, fasteners welded to said tubes and holding down same to the furnace wall.

2. A contrivance as claimed in claim 1 incorporating additional fasteners loosely fitted to at least two said tubes and connected to the block through the intermediary of one of said means of fastening.

* * * * *